US009427884B2

(12) United States Patent
Dunyon et al.

(10) Patent No.: US 9,427,884 B2
(45) **Date of Patent: *Aug. 30, 2016**

(54) VACUUM RELEASE SYSTEMS

(75) Inventors: Christopher Leon Dunyon, West Haven, UT (US); Bret Dunyon, Salt Lake City, UT (US); Richard L. Bell, Issaquah, WA (US)

(73) Assignee: Fluid n Motion, LLC, Taylorsville, UT (US)

( * ) Notice: Subject to any disclaimer, the term of this patent is extended or adjusted under 35 U.S.C. 154(b) by 163 days.

This patent is subject to a terminal disclaimer.

(21) Appl. No.: 13/571,952

(22) Filed: Aug. 10, 2012

(65) Prior Publication Data

US 2013/0037150 A1 Feb. 14, 2013

Related U.S. Application Data

(60) Provisional application No. 61/521,858, filed on Aug. 10, 2011.

(51) Int. Cl.
*B26F 1/14* (2006.01)
*B65D 77/22* (2006.01)

(52) U.S. Cl.
CPC ..... *B26F 1/14* (2013.01); *B65D 77/225* (2013.01); *B65D 2205/00* (2013.01); *Y10T 137/7879* (2015.04)

(58) Field of Classification Search
CPC ... B26F 1/14; B65D 77/225; B65D 2205/00; Y10T 137/7879
USPC ..... 222/80, 83, 85, 86, 478, 479, 481, 222/481.5, 482, 484, 525; 30/366, 367, 30/443; 83/30; 220/745
See application file for complete search history.

(56) References Cited

U.S. PATENT DOCUMENTS

| | | | | |
|---|---|---|---|---|
| 3,884,238 | A * | 5/1975 | O'Malley et al. | 606/107 |
| 8,453,871 | B2 * | 6/2013 | Dunyon et al. | 220/745 |
| 2010/0101102 | A1 * | 4/2010 | Tofte | 30/443 |

* cited by examiner

*Primary Examiner* — John K Fristoe, Jr.
*Assistant Examiner* — Josephine Trinidad-Borges
(74) *Attorney, Agent, or Firm* — Olympic Patent Works PLLC

(57) ABSTRACT

Vacuum release systems that allow rapid, uninterrupted flow of a liquid through a first opening in a container when the container is inverted are disclosed. The vacuum release systems include a hole punch and can be secured to the outer surface of the container. When the liquid-filled container is inverted, pressure is applied to the hole punch to form a second opening in the side of the container. The second opening releases the vacuum by allowing air to flow into the container, which, in turn, allows rapid, uninterrupted flow of the liquid through the first opening in the container.

7 Claims, 8 Drawing Sheets

600
106
130
608
602
604
612
612
102
114
610
606
610
114

600
Force
602
614
606
616

600
134
Air
Relaxed Force
602
134
Air
118
118
612
Air
Air
612
614
616

600
602
118
116
118
610
610
614
110
102
114
Liquid
616
Liquid
110
614

VACUUM RELEASE SYSTEMS

CROSS-REFERENCE TO RELATED APPLICATION

This application claims the benefit of Provisional Application No. 61/521,858, filed Aug. 10, 2011.

TECHNICAL FIELD

This disclosure is directed to systems for releasing a vacuum in an open inverted container.

BACKGROUND

A liquid can be slowly and steadily drained through a single opening in a container by tilting the container so that air flows into the container through the opening while the liquid is flowing out through the opening. However, in an effort to increase the flow rate of the liquid, one typically inverts the container, but the liquid contents block the opening, preventing air from entering the container. As a result, a vacuum forms within the container which is repeatedly released when small amounts of the liquid falls through the opening followed by volumes of air that rapidly rush into the container through the same opening. This repeated interruption in the flow of the liquid causes the container to jolt up and down and sideways as the mass of the liquid contents rapidly changes and the liquid sloshes with each quick release of a small amount of the liquid through the opening. The jolts subside and a smooth steady flow of the liquid eventually occurs after much of the liquid is emptied and can no longer prevent the flow of air into the container.

SUMMARY

Vacuum release systems that allow rapid, uninterrupted flow of a liquid through a first opening in a container when the container is inverted are disclosed. The vacuum release systems include a hole punch and can be secured to the outer surface of the container. When the liquid-filled container is inverted, pressure applied to the hole punch forms a second opening in the side of the container. The second opening releases the vacuum by allowing air to flow into the container through the second opening. As a result, the liquid contents are rapidly emptied from the container through the first opening without interruption in the flow.

DETAILED DESCRIPTION

Figure 1:
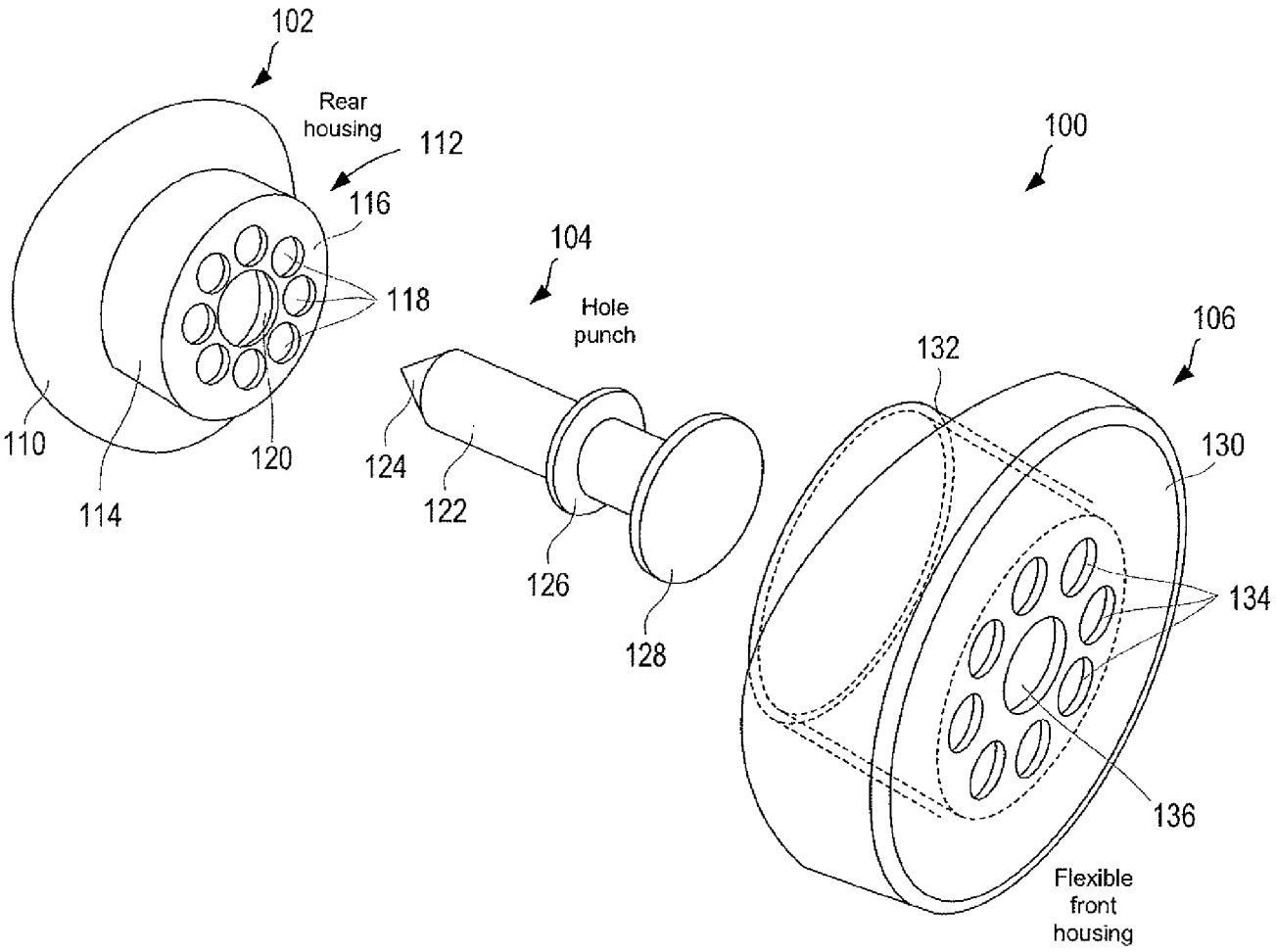
FIG. 1 shows an exploded perspective view of an example vacuum release system.

Various vacuum release system embodiments are now described. FIG. 1 shows an exploded perspective view of an example vacuum release system 100. The system 100 includes a rear housing 102, a hole punch 104, and a front housing 106. The rear housing 102 includes a curved ring-shaped plate 110 and a male end 112 composed of hollow cylinder 114 with a perforated base 116 that includes a number of vents 118 distributed around a first central opening 120. The punch 104 includes a shaft 122 with a tapered end 124 and a ring 126 disposed along the shaft 122 and a head 128 opposite the tapered end 124. The front housing 106 includes a face 130 and a hollow cylinder 132 that extends from the face 130. A central portion of the face 130 is a base for the cylinder 132 and includes a number of vents 134 distributed around a second central opening 136 that lie within the base of the cylinder 132. The cylinder 132 forms a female end to receive the male end 112 of the rear housing 102.

Figure 2A:
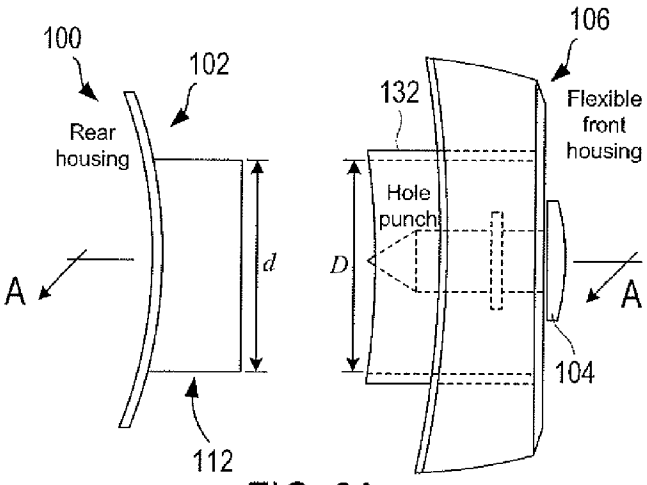
FIG. 2A shows a side view of the vacuum release system shown in FIG. 1.
Figure 2B:
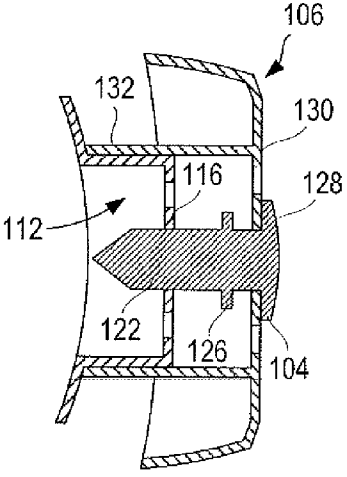
FIG. 2B shows a cross-sectional view of the vacuum release system shown in FIG. 2A along a line A-A.

FIG. 2A shows a side view of the system 100. FIG. 2B shows a cross-sectional view along a line A-A, shown in FIG. 2A, of the male end 112 of the rear housing 102 inserted into the female end of the front housing 106. The male end 112 can be press fit into the female end. This is accomplished with the diameter d of the male end 112 of the rear housing 102 being slightly larger than, slightly smaller than, or approximately the same as the diameter D of the cylinder 132 in order to create frictional forces between the inner wall of the cylinder 132 and the inner surface of the cylinder 114 that hold the male end 112 within the cylinder 132.

Figure 3A:
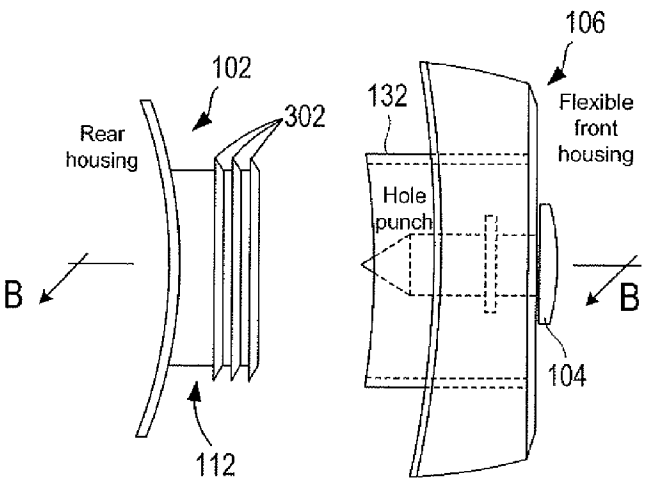
FIGS. 3A-3B show side and cross-sectional views of an example vacuum release system.
Figure 3B:
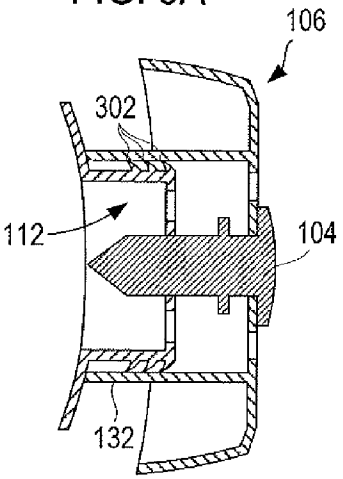

Alternatively, as shown in FIG. 3A, the male end 112 of the rear housing 102 can include a number of tapered rings 302 located along the outside of the cylinder 114. FIG. 3B shows a cross-sectional view along a line B-B, shown in FIG. 3A, of the male end 112 of the rear housing 102 inserted into the female end of the front housing 106. The male end 112 can be press fit into the female end with the diameter of the rings 302 being slightly larger than, slightly smaller than, or approximately the same as the diameter of the cylinder 132 in order to create frictional forces between the rings and the inner surface of the cylinder 114 that hold the male end 112 within the cylinder 132.

In still other embodiments, the male end 112 of the rear housing 102 and the female end of the front housing 106 can be threaded so that the male end 112 can be securely fastened to the female end.

The front housing 106 is composed of a flexible material, such as rubber, that compresses when a force is applied and springs back to its original shape when the force is removed. The rear housing and hole punch can be composed of plastics, thermoplastics, aluminum, steel, or any other suitable material. The rear and front housings, hole punches, and caps can be fabricated using any combination of injection molding and/or machining to achieve the desire shape and size of the vacuum release system components.

Figure 4B:
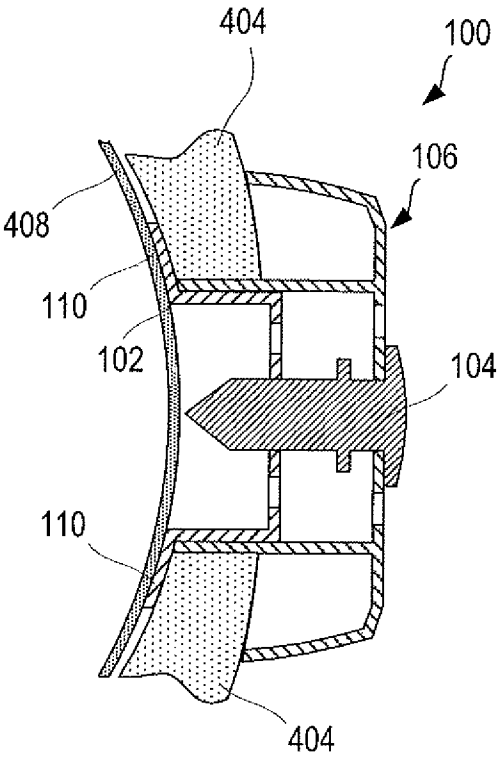
FIGS. 4A-4F show isometric and cross-sectional views of an example implementation of the vacuum release system shown in FIG. 1.
Figure 4A:
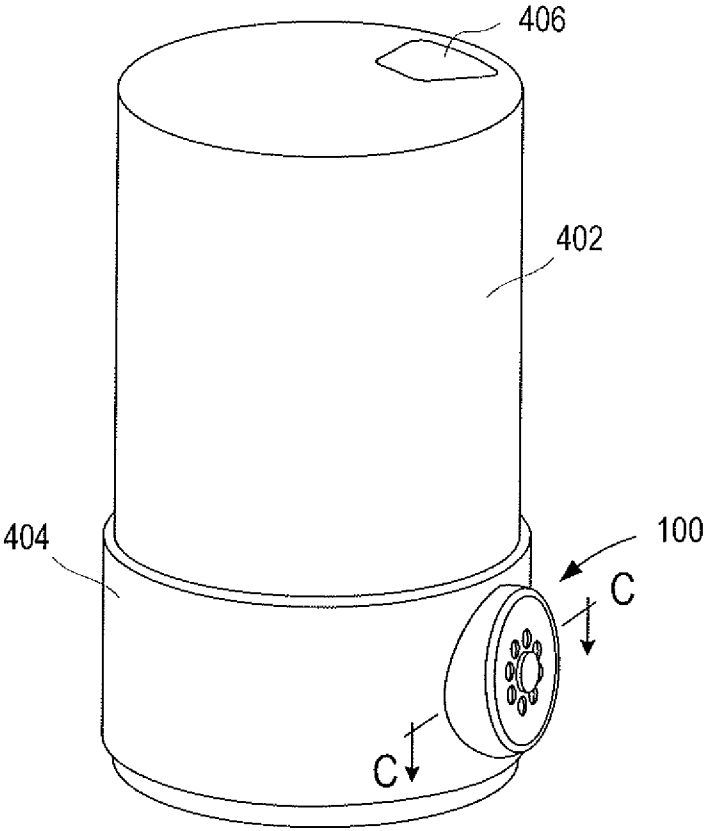
Figure 4D:
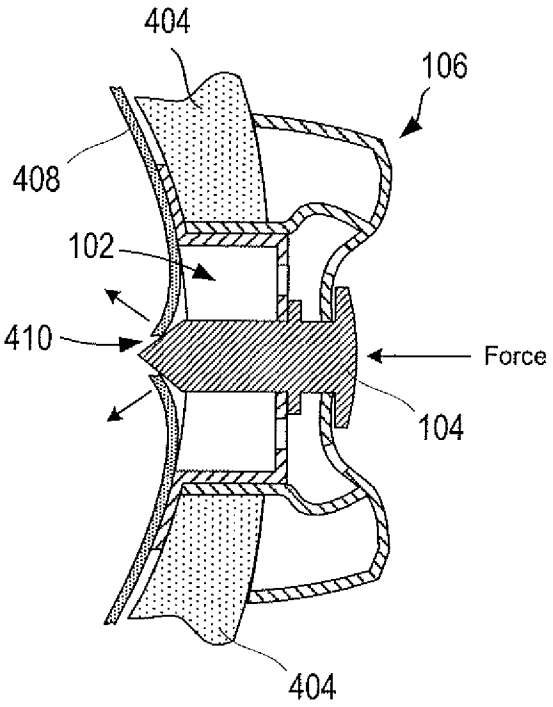
Figure 4C:
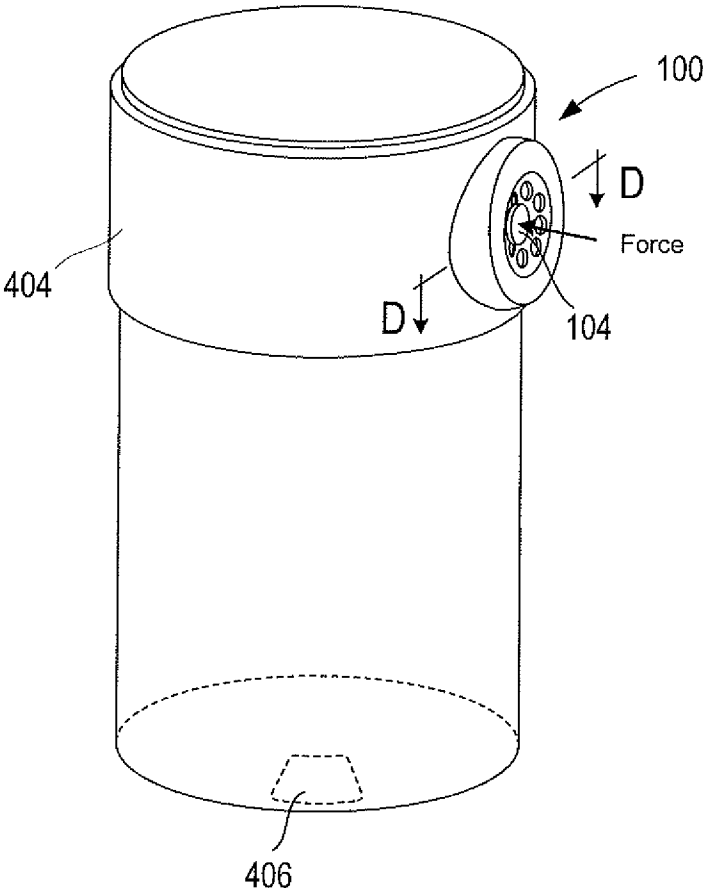
Figure 4F:
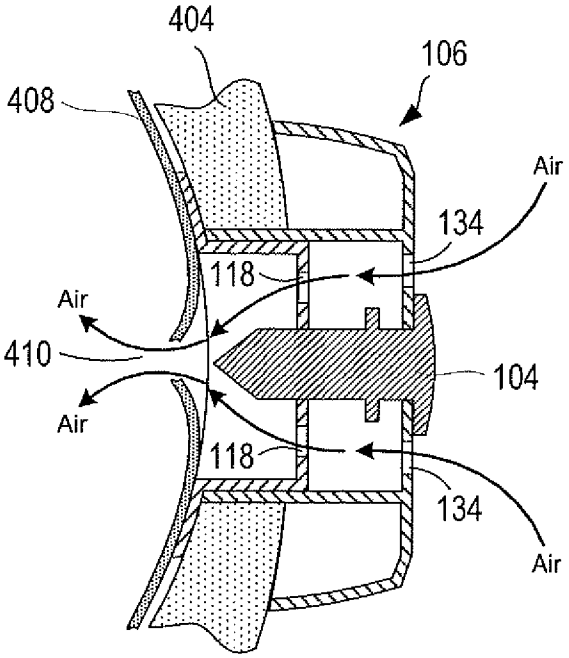
Figure 4E:
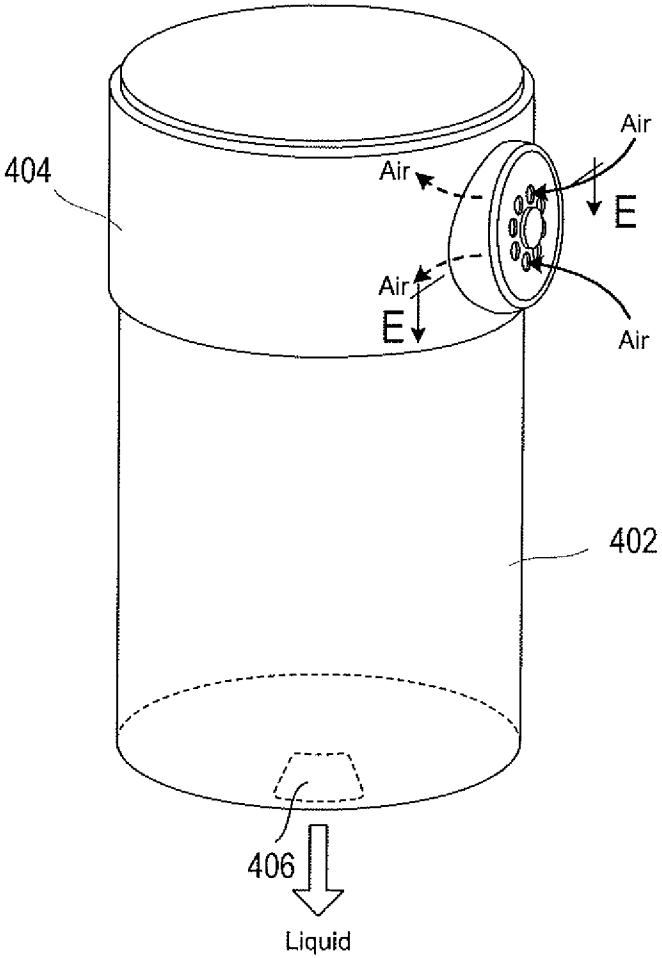

FIGS. 4A-4F show isometric and cross-sectional views of an example implementation of the vacuum release system 100. In FIG. 4A, the system 100 is secured near the base of an upright liquid-filled container 402 with a sleeve 404 that wraps around the base of the container 402. The container 402 includes a small first opening 406 through which the liquid contents of the container are to be emptied. Although, the sleeve 404 is shown as a wrap that encompasses a portion of the cylindrical wall of the container 402, the sleeve can include a base (not shown) so that the sleeve can encase the bottom and cylindrical wall of the container 402. The sleeve 404 can be composed of a fabric, foam, or an insulating material. FIG. 4B shows a cross-sectional view of the system 100 along a line C-C, shown in FIG. 4A. The system 100 is thinly attached to a portion of the cylindrical wall 408 of the container 402. The sleeve 404 includes an aperture through which the female end of the front housing 106 is inserted. As shown in the cross-sectional view, the plate 110 of the rear housing 102 is disposed between the wall 408 and the sleeve 404 and a portion of the sleeve 404 surrounding the aperture substantially fills a gap between the plate 110 and the front housing 106. In FIG. 4C, the container 402 is inverted to empty the liquid contents through the first opening 406. When the container 402 is inverted, as shown in FIG. 4C, a vacuum forms inside the container 402, which is released when a force applied to the head of the hole punch 104 forms a second opening in the container wall 408. FIG. 4D shows a cross-sectional view of system 100 along a line D-D, shown in FIG. 4C. The force drives the punch 104 so that the tapered end 124 of the punch 104 forms a second opening 410 in the wall 408 of the container 402. FIG. 4D also reveals that a portion of the front housing 106 around the punch 104 is compressed. When the force applied to the punch 104 is removed, the front housing 106 springs back to its uncompressed shaped which, in turn, removes the punch 104 from the hole 410 so that air can flow into the interior of the container 402, as shown in FIG. 4E. FIG. 4F shows a cross-sectional view of the system 100 along a line E-E shown in FIG. 4E. In FIGS. 4E-4F, the vacuum is released as the liquid begins to empty through the first opening 406 and air is drawn into the container 402 through the vents 118 and 134 in the rear and front housings 102 and 106. The second opening 410 releases the vacuum formed in the inverted container 402 by allowing air to flow into the container 402 through the vents 118 and 134. As a result, the liquid contents of the container 402 can rapidly flow uninterrupted through the first opening 406, as shown in FIG. 4E.

Figure 5:
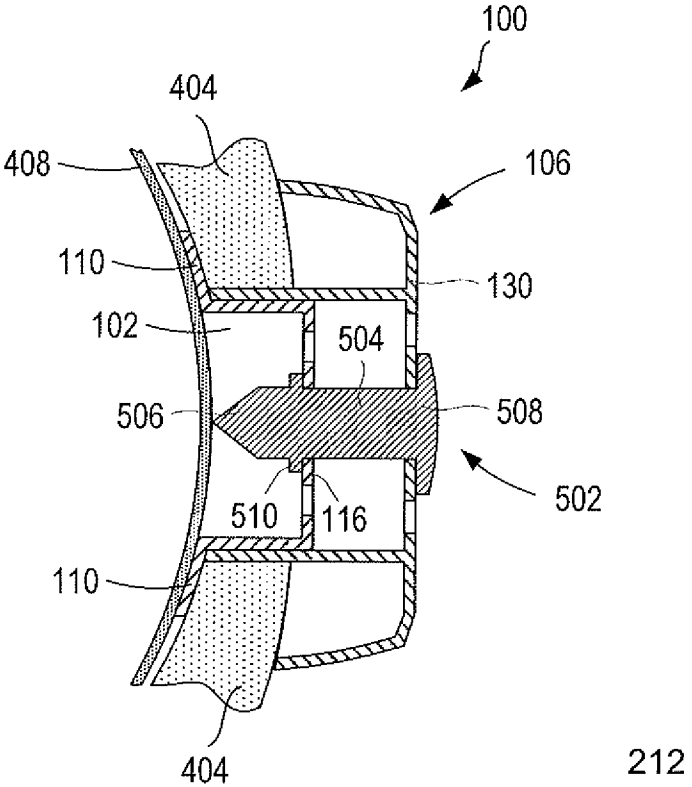
FIG. 5 shows an example of a hole punch.

Returning to FIG. 2B, the ring 126 is positioned to lie between face 130 of the front housing 106 and the base 116 of the rear housing 102. The ring 126 is positioned along the shaft 122 in close proximity to the head 128 to prevent the punch 104 from falling through the opening 136 in the front housing 106. Alternatively, the ring can be positioned along the shaft and spaced an appropriate distance from the head in order to secure the rear housing to the front housing. FIG. 5 shows an example of a hole punch 502 that includes a shaft 504, a tapered end 506, a head 508, and a ring 510 located along the shaft and spaced from the head 508 so that the ring 510 lies against the inner surface of the base 116 and the head 508 lies against the outer face 130 of the front housing 106. The ring 510 and head 508 are spaced along the shaft 504 so that when the system 100 is assembled as shown in FIG. 5, the ring 510 and head 508 do not compress the flexible front housing 106 but instead apply enough force to secure the rear housing 102 to the front housing 106 and accommodate the thickness of the sleeve 404.

Figures 6A, 6B, 6C, 6D:
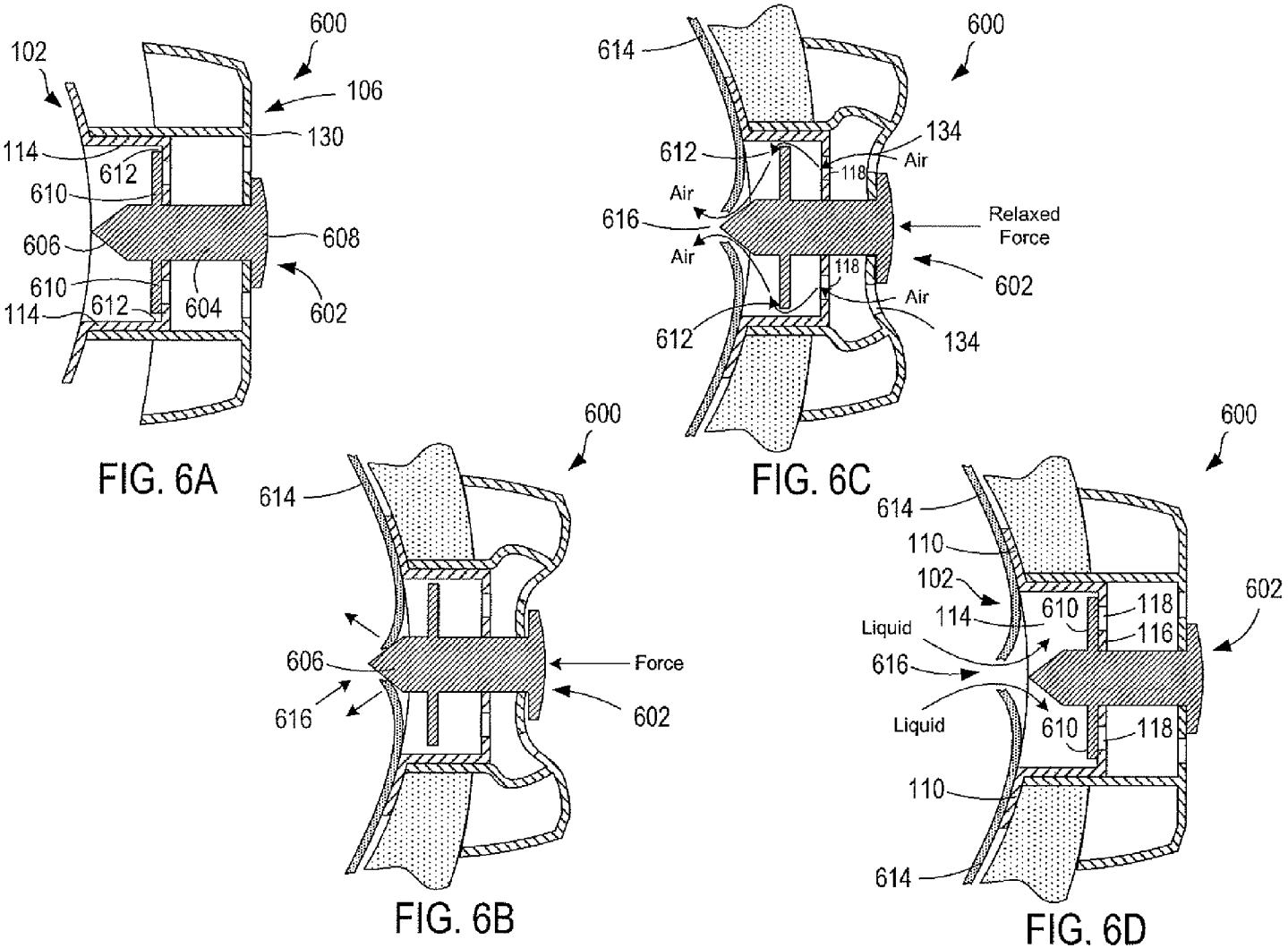
FIG. 6A shows a cross-sectional view of an example vacuum release system.
FIGS. 6B-6D show cross-sectional views of an example implementation of the vacuum release system shown in FIG. 6A.

Alternatively, the diameter of the ring of the hole punch can be extended to cover the vents in the base of the rear housing. As a result, the hole punch can be used to form a hole in the wall of container, as described above with reference to FIGS. 4C-4D, and can be used as a value to allow air to flow into the container when the container is inverted, as described above with reference to FIGS. 4E-4F, and prevent liquid from draining through the second opening when the container is placed upright. FIG. 6A shows an example of a system 600. The system 600 is similar to the system 100 described above except the system 600 includes a hole punch 602 with a shaft 604, a tapered end 606, a head 608, and a ring 610 located along the shaft and is spaced from the head 608 as described above with reference to FIG. 5. As shown in FIG. 6A, the diameter of the ring 610 is large enough the cover the vents 118 in the base 116 of the rear housing 102 but does not extend to the inner wall of the cylinder 114, leaving a ring-shaped gap between the inner wall of the cylinder 114 and the outer edge of the ring 610.

FIGS. 6B-6D show cross-sectional views of an example implementation of the vacuum release system 600 shown in FIG. 6A. The system 600 is attached to a cylindrical wall 614 of a container and operated in a similar manner to the system 100. In FIG. 6B, a force is applied to the head 608 of the punch 602 to than a second opening 616 in the wall 614 of the inverted container, as described above with reference to FIG. 4C-4D. In FIG. 6C, the force applied to the punch 602 can be relaxed, air flows in the inverted container through the vents 118 and 134, the gap 612, and the second opening 616 so that the liquid contents of the container can flow freely through the first opening, as described above with reference to FIGS. 4E-4F. In FIG. 6D, the force applied to the punch 602 is removed and the front housing 106 springs back to its uncompressed shaped which, in turn, forces the ring 610 against the inner surface of the plate 116. When the container is restored to an upright position, a portion of any remaining liquid contents of the container may flow into the hollow space of the cylinder 114 through the second opening, as shown in FIG. 6D. However, because the ring 610 is forced against the plate 116, the liquid is prevented from flowing out though the vents 118. Note that the rear housing 102 can be composed of a flexible material that forms a seal with the container wall 616 to prevent the liquid from leaking out between the plate 110 and the container wall 614. For example, the rear housing 102 can be composed of rubber or the plate 110 can be composed of rubber.

Figure 7:
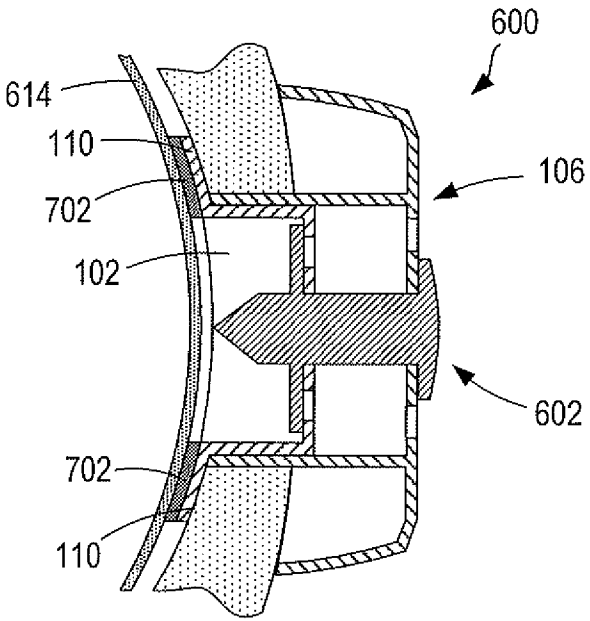
FIG. 7 shows a cross-section view of the vacuum release system shown in FIG. 6A including a gasket.

Alternatively, FIG. 7 shows a cross-sectional view of the system 600 including a gasket 702 disposed between the plate 110 and the container wall 616. The gasket 702 prevents the liquid from leaking out between the plate 110 and the container wall 614 when the container is restored to an upright position.

Note that in the above described examples, the hole punches are described as having cylindrical shaped shafts and the rear and front housings include circular shaped openings dimensioned to receive the shafts and operate as guides along which the punch slides. However, embodiments of the vacuum release systems are not intended to be so limited. Hole punches can also have square, rectangular, triangular, or any other polygonal cross-sectional shape, and the corresponding openings in the rear and front housings can be similarly shaped to receive the cross-sectional shapes of the shafts.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Obviously, many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the following claims and their equivalents:

The invention claimed is:

1. A vacuum release system comprising:

a hole punch having a shaft with a tapered end and a head; and a housing including two aligned and opposing first and second openings, and at least one first vent located in the housing around the first opening and at least one second vent located in the housing around the second opening, the housing encloses a portion of the shaft disposed within the first and second openings, the head larger than the first opening, and the housing is composed of a flexible material that compresses when a force is applied to the head of the punch to move the punch in a first direction, and when the force is removed the housing is restored to an uncompressed shape to move the punch in a direction opposite the first direction.

2. The system of claim 1, wherein the hole punch includes a ring, the ring having a diameter large enough to cover the at least one first vent when the housing is in an uncompressed state.

3. The system of claim 1, wherein the first and second openings are guides to steady and direct the punch.

4. A vacuum release system comprising:

a hole punch having a shaft with a tapered end, a head, and a ring located along the shaft;

a rear housing having a first opening dimensioned to receive the shaft of the punch; and a front housing having a second opening dimensioned to receive the shaft, the front housing and rear housing are connected with the first opening aligned with the second opening to form a guide to steady and direct the punch, the punch is oriented with the tapered end toward the rear housing, and the front housing is composed of a compressible material such that when a force is applied to the head of the punch the front housing collapses to allow the punch to move in a first direction, and when the force is removed the housing is restored to an uncompressed shape to move the punch in a direction opposite the first direction.

5. The system of claim 4, wherein the front housing further comprises tapered rings to create frictional forces that attaches the front housing to the rear housing.

6. The system of claim 4, wherein the front housing further comprises at least one vent located away from the first opening and the rear housing further comprises at least one vent located away from the second opening to allow air to flow through the at least one vent in the front housing and the at least one vent in the rear housing.

7. The system of claim 4, wherein the ring has a diameter large enough to cover the at least one vent located in the rear housing.

* * * * *